US005644795A

United States Patent [19]

Landis et al.

[11] Patent Number: 5,644,795

[45] Date of Patent: Jul. 8, 1997

[54] GOLF GLOVE

[76] Inventors: George Landis, 6261 Whispering Meadows, Canfield, Ohio 44406; Phil Courtney, 7404 Eisenhower Dr., Apt. 7, Boardman, Ohio 44512

[21] Appl. No.: 629,449

[22] Filed: Apr. 8, 1996

Related U.S. Application Data

[63] Continuation-in-part of Ser. No. 495,074, Jun. 27, 1995, abandoned.

[51] Int. Cl.[6] ..... A41D 19/00

[52] U.S. Cl. ..... 2/161.3

[58] Field of Search ..... 2/159, 160, 161.1, 2/161.2, 161.3, 161.8; 273/166, 187.2, 189 R; 473/205

[56] References Cited

U.S. PATENT DOCUMENTS

| | | | |
|---|---|---|---|
| 2,465,136 | 3/1949 | Troccoli | 2/161.3 |
| 3,278,944 | 10/1966 | Gowers | 2/159 |
| 3,848,874 | 11/1974 | Elkins, Jr. | 2/161.2 |
| 3,997,922 | 12/1976 | Huhta | 2/161.1 |
| 4,590,625 | 5/1986 | Keim | 2/161.3 |
| 4,665,565 | 5/1987 | Odom | 2/161.2 |
| 4,691,387 | 9/1987 | Lopez | 2/161.3 |
| 5,028,050 | 7/1991 | Freyer | 2/161.3 |
| 5,164,231 | 11/1992 | Davis | 2/161.3 |
| 5,184,353 | 2/1993 | Goldwitz | 2/161.2 |
| 5,218,719 | 6/1993 | Johnson | 2/161.1 |
| 5,232,225 | 8/1993 | Snyder | 2/161.3 |
| 5,511,248 | 4/1996 | Widdemer | 2/161.3 |
| 5,542,126 | 8/1996 | Harvenek | 2/161.2 |

*Primary Examiner*—Michael A. Neas
*Attorney, Agent, or Firm*—Harpman & Harpman

[57] ABSTRACT

A golf glove and method of using same wherein the glove has a plurality of aligned inserts that provide a sure grip on the golf club. The inserts also define a preferred golf club grip position by illustrating to the user proper position of the golf club in the hands. The aligned inserts are of a non-slip material that are of a contrasting color to the glove's primary color defining a sure grip positioning system for the golfer assuring proper club hand placement.

9 Claims, 2 Drawing Sheets

GOLF GLOVE

This is a Continuation in Part patent application of Ser. No. 08/495,074, filed Jun. 27, 1995 now abandoned.

BACKGROUND OF THE INVENTION

1. Technical Field

This device relates to sports gloves used in the art of golf aids, more particularly to improve golf gloves with non-slip club alignment features.

2. Description of Prior Art

Prior art devices of this type have relied on a variety of different glove configurations to help hold and position a golf club in the golfer's hands. It is important in the game of golf to achieve a proper grip on the golf club to optimize performance. In order to enhance the golfer's grip on the clubs and to aid in the grip placement, a number of prior art patents have been cited, see for example U.S. Pat. Nos. 3,278,944, 3,848,874, 5,028,050, 5,184,353, 2,465,136, 3,997,922, 4,590,625, 4,665,565, 4,691,387, and 5,218,719.

In U.S. Pat. No. 3,278,944 a means for assisting in the teaching of golf is disclosed wherein a golf glove has three continuous strips secured to the back of the glove, each strip being of a distinct color. By citing on the color strips, the golfer's grip position can be analyzed before the club is swung.

Pat. No. 3,848,874 is directed to a golf glove and system having a indecia on the glove's back and thumb portion to present a visual guide and site line along the thumb as the golf club is gripped which then defines that a proper grip has been achieved.

A golfer's grip training device is disclosed and claimed in U.S. Pat. No. 5,028,050 wherein a pair of golf gloves are utilized to interlock to one another along selected areas defining a proper grip and maintaining same about the club. Hook and loop fasteners are positioned on respective gloves for overlapping engagement during use.

Pat. No. 5,184,353 defines a golf glove construction wherein knuckle portions are defined by inserts thereon along with openings for rings and the like that are positioned on the respective finger elements. Alignment bands are applied across the fingers of the palm side of the glove to define a golf placement and gripping portion.

Pat. No. 5,232,225 discloses a golf club grip and positioning aid wherein a pair of gloves have registering hook and loop material thereon that interlock to one another along the fingers and the thumb portions.

Referring to the remaining Patents, U.S. Pat. Nos. 2,465,136, 3,532,344, 3,997,922, 4,590,625 and 4,691,387, all disclose gloves having multiple gripping surfaces on the fingers and palm portions in side by side traverse aligned relationship.

In U.S. Pat. No. 4,665,565, loop and pile fasteners are positioned on the fingertips and adjacent the thumb base on the palm.

In U.S. Pat. No. 5,218,719, a batting glove is disclosed defining two aligned strip areas in spaced parallel relation to one another on the finger portion and across the palm portion.

Finally, in U.K. Patent 1013381 a hook and loop strip extends up each finger and at right angles to one another on the palm portion for enhanced grip.

U.K. Patent 2,232,338 shows a glove with a "padded means" opposite said thumb portions.

SUMMARY OF THE INVENTION

The present invention provides for a single golf glove that helps position and grips the golf club in a preferred and secured manner. The glove has a number of tactile surfaces positioned along the glove's fingers and palm portion that when in contact with the golf club positions the club in the golfer's hand in a proper grip alignment and provides enhanced gripping of the club by a fabric component of which the surface inserts are made.

DESCRIPTION OF THE PREFERRED EMBODIMENT

Figure 1:
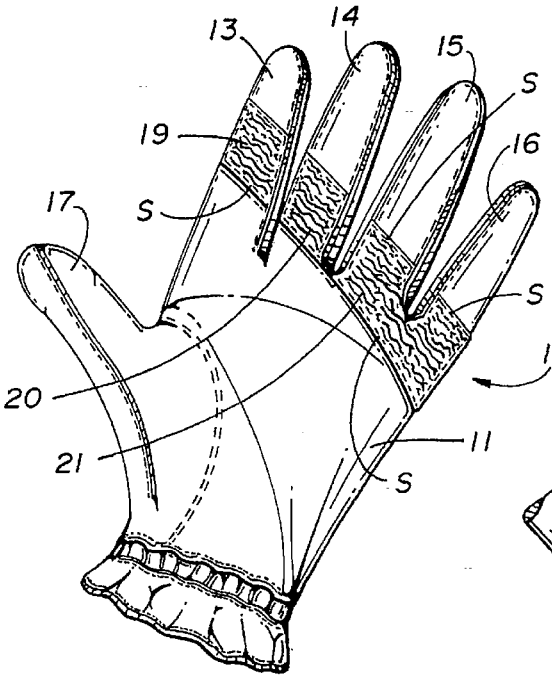
FIG. 1 is a perspective view of the golf glove showing the insert strips aligned along the fingers of the glove.
Figure 2:
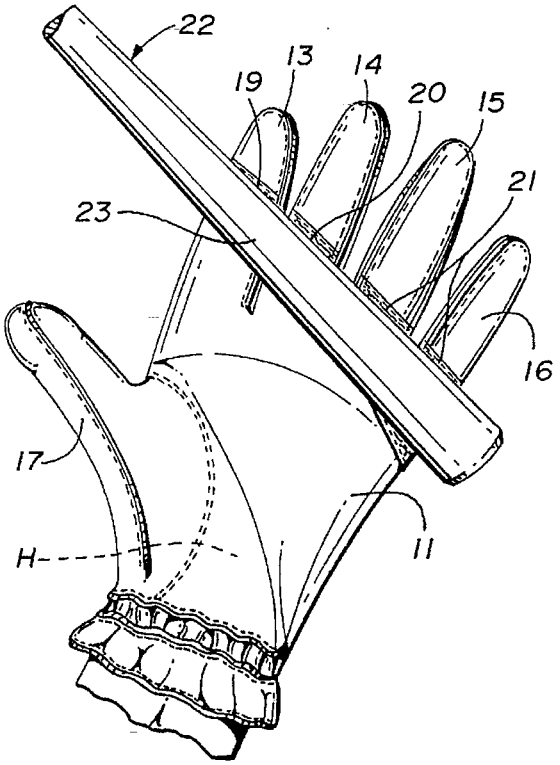
FIG. 2 is a perspective view of the palm portion of the golf glove with a golf club gripped aligned thereon.

Referring to FIGS. 1 and 2 of the drawings, a golf glove 10 can be seen having a palm portion 11, a plurality of selected finger portions 13, 14, 15, and 16 with an opposing thumb portion 17 as will be well understood by those skilled in the art. The glove 10 has a number of material inserts 19, 20 and 21 that are positioned on the finger portions 13–15 respectively.

Each of the finger portions 13 & 14 have respective inserts 19 and 20 extending transversely thereacross in aligned angular inclination to one another. The insert 19 is positioned midway along the finger portions 13's longitudinal length which defines one element of a proper golf club grip that will be discussed in greater detail hereinafter.

The insert 20 is positioned on the finger portion 14 adjacent its termination with the glove palm portion 11 as best seen in FIG. 1 of the drawings.

The insert 21 extends transversely across both finger portions 15 and 16 at their respective base adjoining the palm portion 11 and additionally extends over a portion of the palm 11 in angular alignment with the hereinbefore described inserts 19 and 20. The inserts 19–21 are preferable of a synthetic material having the characteristic properties of a non-slip increase frictional co-efficient over the surrounding glove material which will be well known to those skilled in the art.

Referring now to FIG. 2 of the drawings, the golf glove 10 of the invention can be seen with a golf club 22 positioned thereacross. The club 22 has a handle grip portion 23 by which the user grips the club 22.

The handle grip portion 23 of the club 22 is positioned in the glove 10 of the invention so that the respective inserts 19–21 are in abutting overlapping position with the club's handle portion 23. It will be evident from the above description that a preferred golf grip is achieved by the angular alignment of the club's handle portion 23 over the inserts 19–21 across the finger portions of the glove 10.

Figure 3:
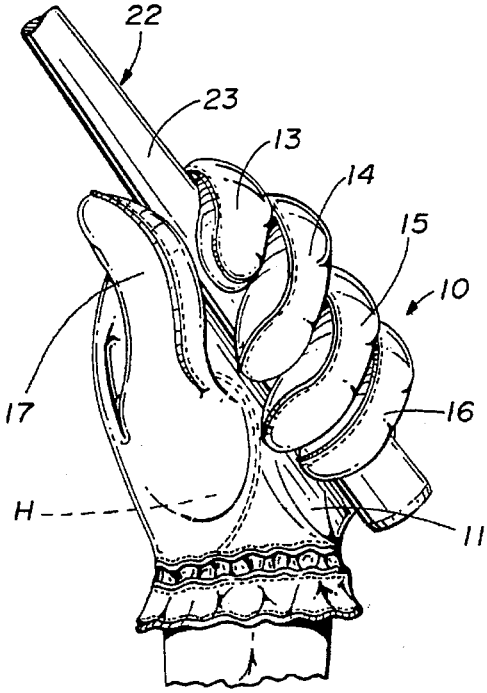
FIG. 3 is a perspective view of the golf glove engaging about the golf club defining the sure grip position thereabout.

Referring now to FIG. 3 of the drawings, the golf glove 10 is shown on a user's hand H in closed grip position about the golf club's handle portion 23 in a preferred superior non-slip grip.

The inserts 19, 20, and 21 are preferably secured to the glove's respective fingers and palm portions 13, 14, 15, 16, and 11 by replacing the selective glove material in the areas defined by sewing as illustrated by the seams S or similar fabric adjoining techniques common to glove construction as best seen in FIGS. 1 and 2 of the drawings.

Alternate attachment methods may also be used such as overlaying selective fabric inserts 19–21 as herein before disclosed on the finger portions and adhering same by adhesive means.

Since the gripping inserts 19–21 are secured only to the glove's finger portion's palm side and do not extend about the finger portions, attachment means can be simple which will enhance the ease of construction achieved without substantially altering the general glove construction.

It will also be apparent from the foregoing that the grip alignment feature of the inserts 19–21 can be achieved by simply imprinting a contrasting color band across the finger portions of the glove without required inserts as visually illustrated in FIGS. 1 and 2 of the drawings by the inserts 19–21, portions effective textured illustration hereinbefore to indicate a gripping surface 42A.

Figure 4:
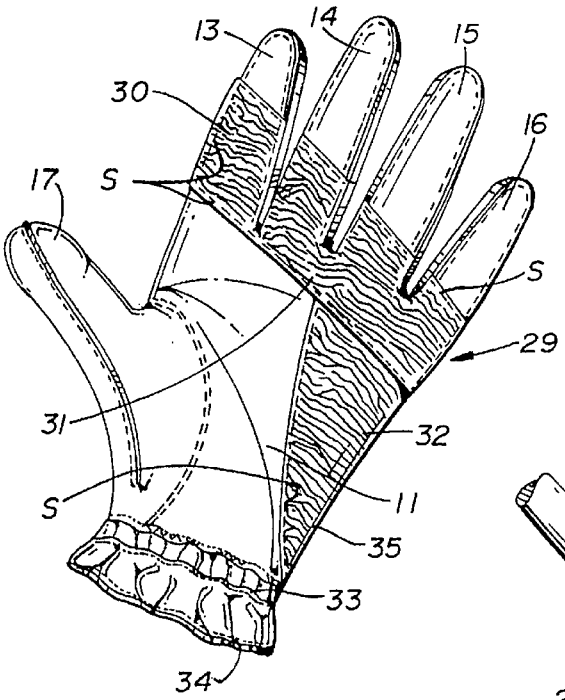
FIG. 4 is a perspective view of the palm portion of an alternate form of the golf glove with enhanced gripping and alignment portions thereon.
Figure 5:
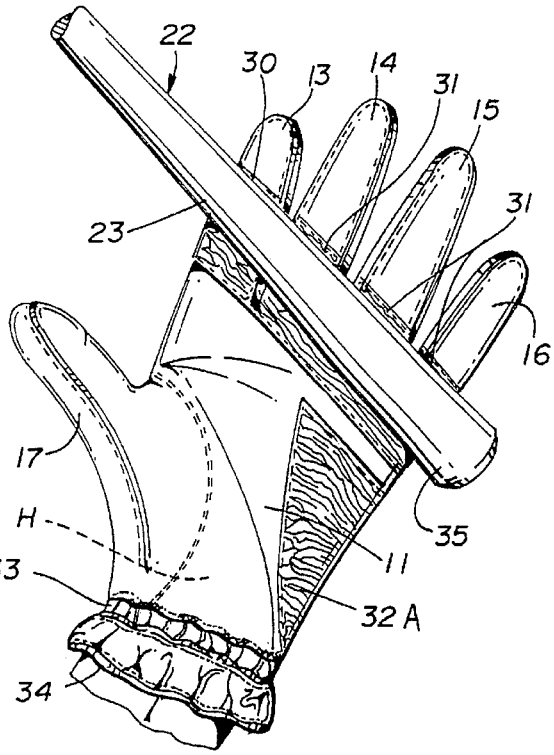
FIG. 5 is a perspective view of the palm portion of the alternate form of the golf glove with a golf club aligned therein.
Figure 6:
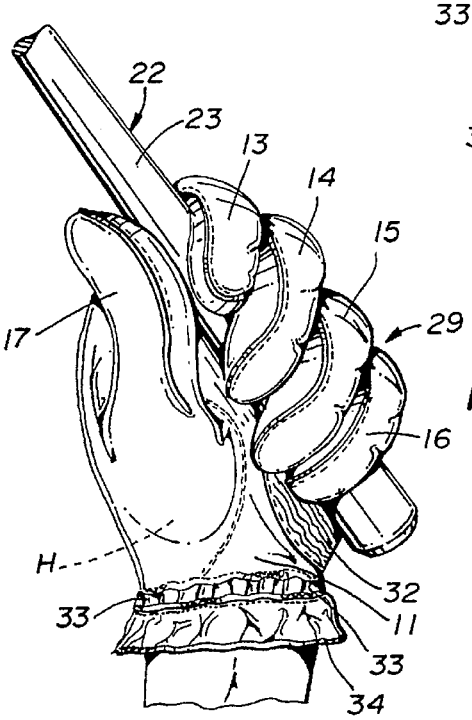
FIG. 6 is a perspective view of the golf glove shown in FIG. 4 of the alternate form of the golf glove which is engaged about the golf club defining an improved sure grip position thereon.

Referring now to FIGS. 4, 5, and 6 of the drawings, an alternate form of the golf glove 10 is illustrated as golf glove 29 can be seen wherein material inserts 30 and 31 are positioned on the finger portions 13 and 14, 15, 16 respectively. The finger portion 13 has the material insert 30 extending transversely from its termination point with the glove palm portion 11 and is angularly aligned with the material insert 31 that extends transversely across the remaining finger portions 14, 15, and 16 and progressively beyond onto the glove palm portion 11, best seen in FIG. 4 of the drawings. A palm insert 32 abuts the material insert 31 opposite said finger portions 15 and 16 and extends arcuately therefrom to an elastic band 33 inwardly from the golf glove opening 34 as is typical in the art. The palm insert 32 terminates along a seam line at 35 that defines the palm portion 11 from the remaining area of the glove (not shown).

The inserts 30, 31, and 32 are preferably of a natural leather material that has been textured to enhance its frictional co-efficient as compared with the rest of the glove material surrounding it which is well known to those skilled in the art.

Referring now to FIG. 5 of the drawings, an additional form of the invention is illustrated wherein the glove 29 has a modified palm insert 32A that is spaced in relation to said remaining finger insert 31 opposite said finger portions 15 and 16, still defining proper club alignment as illustrated by the golf club handle portion 23 of the golf club 22 positioned across the glove 29 in the same manner as hereinbefore disclosed and illustrated in FIG. 2 of the drawings with the glove 10.

Referring now to FIG. 6 of the drawings, the alternate golf glove 29 is shown on the user's hand H in a closed grip position about the golf club's handle portion 23 in a preferred and enhanced non-slip aligned grip.

The inserts 30, 31, and 32 are preferably secured to the glove's respective fingers and palm portions 13, 14, 15, 16, and 11 by replacing the selective glove material in the areas defined by sewing as illustrated by the seams S or similar fabric adjoining techniques common to glove construction as best seen in FIGS. 1 and 2 of the drawings.

Alternate attachment methods may also be used such as overlaying selective fabric inserts 30–32 as herein before disclosed on the finger and palm portions and adhering same by adhesive means.

Since the gripping inserts 30–32 are secured only to the glove's finger and palm portion's of the palm side of the glove and do not extend about the finger portions, attachment means can be simple which will enhance the ease of construction achieved without substantially altering the general glove construction.

It will also be apparent from the foregoing that the grip alignment feature of the inserts 30–31 can be achieved by simply imprinting a contrasting color band across the finger and palm portions of the glove without required inserts as visually illustrated in FIGS. 1 and 2 of the drawings by the inserts 19–21, portions effective textured illustration hereinbefore to indicate a gripping surface.

The enhanced gripping area achieved by the inserts 32 & 32A on the palm portion 11 opposite the thumb portion 13 addresses the need for increased frictional surface stability at the end portion 35 of the golf club handle 23 which undergoes applied movement during the user's swing as will be well understood by those skilled in the art.

It will thus be seen that a new and novel sure grip and alignment golf club glove has been illustrated and described and it will be apparent to those skilled in the art that various changes and modifications may be made thereto without departing from the spirit of the invention.

Therefore we claim:

1. Gripping and alignment means for a golf club comprising, a golf glove having a palm portion, a plurality of finger portions and a thumb portion, gripping and alignment surfaces located on the palm side surface of said finger and palm portions, a first gripping and alignment surface extending transversely and angularly across said palm side surface of said finger portions, said gripping and alignment surfaces having a frictional co-efficient greater than that of the surrounding surfaces, a portion of said first gripping and alignment surface extending beyond said finger portions to said palm portion, a second gripping and alignment surface comprising a palm insert extending from said portion of said first gripping and alignment surface, which extends beyond said finger portions, said palm insert extending from said first surface to a point beyond said thumb portion and abutting a seam line extending from one of said finger portions of said portion of said first surface that extends beyond said finger portions, means for securing said surfaces to said glove.

2. The gripping and alignment means for a golf club of claim 1 wherein said gripping and alignment surfaces are of a contrasting color to that of said surrounding surfaces.

3. The gripping and alignment means for a golf club of claim 1 wherein said means for securing said surfaces to said glove comprises sewing said surfaces to said finger and palm portions of said glove in place of said glove's material.

4. The gripping and alignment means for a golf club of claim 1 wherein said first gripping and alignment surface is comprised of multiple transverse areas on said respective finger portions in angularly aligned relation to one another wherein one of said transverse areas on said finger portions terminate with said palm portion.

5. The gripping and alignment means for a golf club of claim 1 wherein said gripping and alignment surfaces are of a natural textured material.

6. Gripping and alignment means for a golf club comprising, a golf glove having a palm portion, plurality of finger portions and a thumb portion, gripping and alignment surfaces located on the palm side surface of said finger and palm portions, a first gripping and alignment surface extending transversely and angularly across said palm side surface of said finger portions, said gripping and alignment surfaces having a frictional co-efficient greater than that of the surrounding surfaces, a portion of said first gripping and alignment surface extending beyond said finger portions to said palm portion, a second gripping and alignment surface comprising a palm insert extending in spaced relation from said transverse insert extending beyond said finger portion, said palm insert extending beyond said thumb portions and abutting a seam line extending from one of said finger portions, said palm insert defining a triangle on said glove palm in oppositely disposed relation to said thumb portion, means for securing said inserts to said glove.

7. The gripping and alignment means for a golf club of claim 6 wherein said gripping and alignment surfaces are of a contrasting color to that of said surrounding surfaces.

8. The gripping and alignment means for a golf club of claim 6 wherein said means for securing said surfaces to said glove comprises sewing said surfaces to said finger and palm portions of said glove in place of said glove's material.

9. The gripping and alignment means for a golf club of claim 6 wherein said gripping and alignment surfaces are of a natural textured material.

* * * * *